US005949065A

United States Patent [19]

Kaplan et al.

[11] Patent Number: 5,949,065

[45] Date of Patent: Sep. 7, 1999

[54] SWEEP GENERATOR CIRCUIT FOR A STREAK CAMERA

[75] Inventors: Daniel Kaplan, Paris, France; Marcel A. Bouvier, Ann Arbor, Mich.

[73] Assignee: Fastlite, Palaiseau, France

[21] Appl. No.: 08/990,138

[22] Filed: Dec. 12, 1997

[51] Int. Cl.[6] ..... H01J 29/74

[52] U.S. Cl. ..... 250/214 VT

[58] Field of Search ..... 250/214 VT, 207; 313/528; 315/370, 410

[56] References Cited

U.S. PATENT DOCUMENTS

| | | | |
|---|---|---|---|
| 4,327,285 | 4/1982 | Bradley . | |
| 4,413,178 | 11/1983 | Mourou et al. . | |
| 4,630,925 | 12/1986 | Schiller et al. . | |
| 4,659,921 | 4/1987 | Alfano . | |
| 4,740,685 | 4/1988 | Koishi | 250/214 VT |
| 4,827,317 | 5/1989 | Mizushima et al. . | |
| 4,914,359 | 4/1990 | Takahashi et al. . | |
| 4,920,386 | 4/1990 | Tsuchiya et al. . | |
| 4,942,293 | 7/1990 | Koishi et al. . | |
| 4,945,224 | 7/1990 | Koishi et al. . | |
| 4,988,859 | 1/1991 | Tsuchiya . | |
| 4,999,548 | 3/1991 | Bourcier et al. . | |
| 5,003,168 | 3/1991 | Alfano et al. . | |
| 5,032,714 | 7/1991 | Takahashi et al. . | |
| 5,045,761 | 9/1991 | Takahashi | 315/410 |
| 5,071,249 | 12/1991 | Takahashi et al. . | |
| 5,144,374 | 9/1992 | Grego . | |

OTHER PUBLICATIONS

"Signal Averaging X–Ray Streak Camera with Picosecond Jitter", American Institute of Physics, Mar. 1996, vol. 67, No. 3. pp. 697–699.

*Primary Examiner*—Edward P. Westin
*Assistant Examiner*—Thanh X. Luu
*Attorney, Agent, or Firm*—Young & Basile, PC

[57] ABSTRACT

A sweep generator circuit generates a primary pulsed voltage and a secondary voltage which are applied to the deflection plates of a streak camera. A primary pulsed voltage generator includes at least one light operated switch for producing deflection of an electron beam in one direction. A secondary voltage generator means generates the secondary voltage which causes deflection of the electron beam in an opposite direction. Variations in the incident light intensity create substantially identical fluctuations in the deflection of the electron beam produced by the primary pulsed voltage and the secondary voltage. Additionally, any variations with respect to time in the deflection of the electron beam produced by the secondary voltage are small in comparison with variations in the deflection of the electron beam produced by the primary pulsed voltage. The sweep generator circuit has an operating point that is stable with respect to variations in the light intensity.

14 Claims, 5 Drawing Sheets

SWEEP GENERATOR CIRCUIT FOR A STREAK CAMERA

BACKGROUND OF THE INVENTION

1. Field of the Invention

The present invention relates, in general, to streak cameras or tubes and, more specifically, to sweep drive or sweep generator circuits for streak cameras.

2. Description of the Art:

Optical transient events in the picosecond range, such as events generated by use of ultra fast pulsed lasers, can be measured using streak cameras or tubes. The streak camera includes an electron tube containing a photocathode, a phosphor screen, electron optics consisting of several focusing electrodes, and at least two deflection electrodes or plates.

In a common mode of operation, the investigated optical phenomenon or event is typically in the form of a narrow optical line on the photo cathode, which produces a line image on the phosphor screen along the Y axis. A d.c. voltage applied to the deflection plates moves this line along the X axis perpendicular to the Y axis. To study the optical intensity as a function of time, an electrical signal in the form of a ramp is applied to the deflection plates. The end result is to spread the line image in the X direction or axis to form a streak on the screen. Under these conditions, the variation along the X axis of the optical intensity on the screen at a given level Y represents the time variation of the incoming optical signal at that particular Y level.

To detect very weak repetitive signals, it is necessary to average successive images. However, since the ramp signal is generated electronically, random fluctuations in the starting instant of the ramp will occur. For the necessary high voltage ramp signals, such variations are of the order of 10 picoseconds or more in state of the art streak camera systems. This severely limits the effective time resolution in the averaging mode when optical events are occurring in the sub ten picosecond range.

Mourou has proposed in U.S. Pat. No. 4,413,178 to generate the ramp signal synchronously with the optical signal by use of a photoconductor. In a typical implementation, the ramp generator includes two sections of transmission line and a photoconductor switch consisting of two electrodes on a semiconducting material with high resistivity in the dark or absence of light. The first transmission line is connected to the deflection electrodes through the switch and the second transmission line. A reference optical signal or pulse closes the switch transmitting the deflection voltage to the deflection or sweep electrodes.

Under ideal conditions in which the reference optical signal is perfectly synchronized with the optical phenomenon under study and there is negligible electrical resistance of the photo conductor switch in its conducting state as well as an absence of fluctuations of the high voltage signal, the ramp signal will be perfectly synchronized and averaging may be performed without loss of time resolution. However, it is difficult to provide perfect synchronization due to the finite value of the photoconductor switch resistance and the existence of fluctuations in the intensity of the synchronizing optical signal. These variations cause fluctuations in the amplitude of the ramp signal which result in fluctuations of the correspondence between the time instance of various positions along the X axis on the screen. At the start of the ramp signal, the ramp is stable at a point of time. Any voltage point along the ramp signal can fluctuate with respect to time. Unfortunately, in general, the slope of the ramp has a maximum in the middle of the ramp signal range. Thus, the constraints of a large ramp signal slope for a large time dependent deflection and low jitter are contradictory. As a consequence, averaging of the optical event cannot be performed with adequate temporal resolution.

Thus, it would be desirable to provide a sweep generator circuit for use in a streak camera which has a stable operating point with reduced fluctuation while maintaining large time dependent deflection.

SUMMARY OF THE INVENTION

The present invention is a sweep generator circuit for a streak camera which provides stable operating characteristics to eliminate jitter previously introduced during the generation of the ramp voltage on the deflection plates.

In one embodiment, the sweep generator circuit includes a reference light pulse split from an incident light beam. A primary pulsed voltage generator means is connected to the deflection plates and includes at least one switch operated by the reference light pulse for producing deflection of the electron beam in one direction as the electron beam traverses the deflection plates and a secondary voltage generator means connected to the deflection plates for producing deflection of the electron beam in a direction opposite to the first direction. The primary pulsed voltage generator means and the secondary voltage generator means are arranged such that fluctuations in the reference light pulse cause substantially equal fluctuations in the deflection of electron beam produced by the primary pulsed voltage generator means and by the secondary voltage. Further, the primary and secondary voltage generator means are arranged such that variations with respect to time of deflection caused by the secondary voltage generator means are small compared to variations in deflection produced by the primary pulsed voltage generator means.

Preferably, the outputs of the primary pulsed voltage generator means and the secondary voltage generator means are shifted in time with respect to each other in such a way that, in the time region of interest, the secondary voltage generator means has a nearly time independent output.

Further, the secondary voltage generator means preferably includes a switch substantially identical to the switch in the primary pulsed voltage generator means. The reference light pulse is split into identical light pulses applied equally to both switches.

In one embodiment, the primary pulsed voltage generator means and the secondary voltage generator means apply effective voltages of identical polarity to the first and second deflection plates.

In another embodiment, the primary pulsed voltage generator means and the secondary voltage generator means provide voltages to the same first and second deflection plates of opposite polarity. In this embodiment, the primary pulsed voltage generator means includes a pair of substantially identical switches. The secondary voltage generator means also includes a pair of identical switches.

In another embodiment, the secondary voltage generator means includes a d.c. voltage generator means providing a d.c. voltage to the first and second deflection plates. In this embodiment, the d.c. generator means includes a switch identical to the switch in the primary pulsed voltage generator means. The d.c. generator means provides an output after a predetermined number of reference light pulses.

In one or more of the above-described embodiments, a d.c. polarization voltage is applied to at least one of the first and second deflection plates to position the stable point of the electron beam at an adequate position with respect to an image screen.

In one embodiment, the reference light pulse is split into first and second light pulses. First means are provided for delaying the first and second light pulses. First and second switch means are respectively connected to the primary pulsed voltage generator means and the secondary voltage generator means. Second means are provided for delaying an electrical output signal of each of the first and second switch means to the first and second deflection plates, respectively. Preferably, the switch means employed in one or both of the primary pulsed voltage generator means and the secondary voltage generator means are photoconductors.

The unique sweep generator means or circuit of the present invention provides several advantages over previously devised sweep generator circuits used in streak cameras. The present sweep generator circuit provides a stable operating point with reduced fluctuations while maintaining large time dependent deflections of the electron beam. This is achieved by providing a secondary voltage which is connected to one or more of the deflection plates such that variations in the incident light beam intensity creates substantially equal fluctuations in the deflection of the electron beam produced by the primary pulsed voltage generator means and the secondary voltage generator means. At the same time, variations with respect to time of the deflection of the electron beam produced by the secondary voltage generator means are small in comparison to variations in the deflection of electron beam produced by the primary pulsed voltage generator means. This produces a streak camera having low jitter for improved performance.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENT

Figure 1:
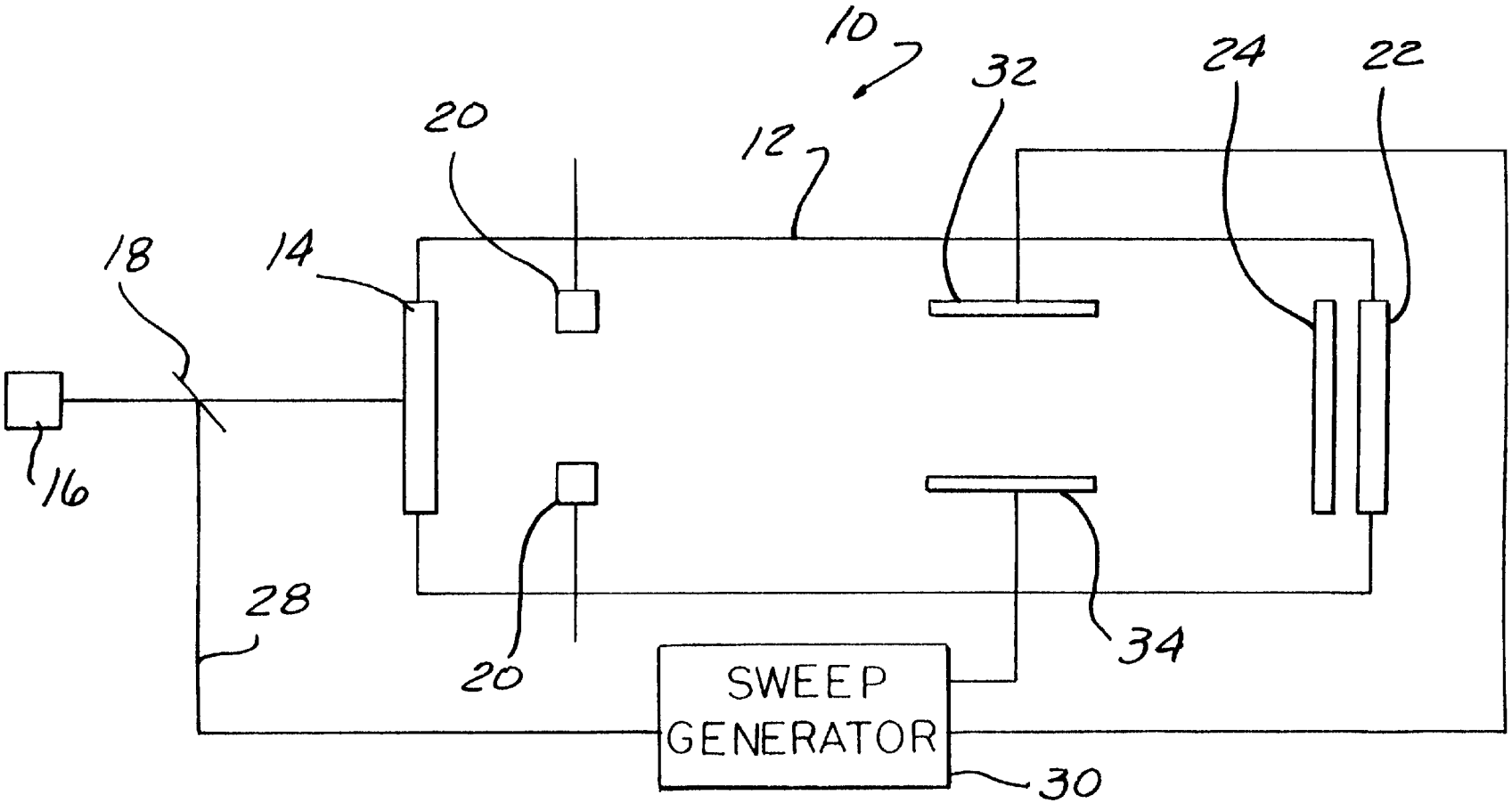
FIG. 1 is a pictorial representation of a streak camera equipped with a sweep generator circuit in accordance with the present invention.

Referring now to the drawings, and to FIG. 1 in particular, there is depicted a streak camera 10 which is configured for producing an optical image of a transient optical event.

As is conventional, the streak camera 10 is formed of a tube 12 having a photocathode 14 mounted at one end. A light source 16, such as an ultra fast, pulsed laser 16, emits a pulse of light which strikes a beam splitter 18 where it is split into a transmitted pulse or incident light beam and a reflected pulse 28 or reflected light beam. The transmitted pulse strikes a sample, not shown, and produces photons which impact on the photocathode 14.

The photocathode 14 converts the photons to electrons which pass through focussing electron optics 20 which accelerate and focus the electrons emitted from the photocathode 14 onto a phosphor target or screen 22 mounted at an opposite end of the streak camera tube 12. An optional microchannel plate 24 may be positioned adjacent the front of the screen 22 to multiply the number of electrons which are imaged on the screen 22. The streak image formed on the screen 22 may be picked up by a camera, not shown, such as a CCD camera, for viewing, digitizing, etc.

The reflected pulse or light beam 28 from the beam splitter 18 is received by the sweep generator circuit 30 and activates the sweep generator circuit to produce ramp signals which are applied to a pair of deflection plates 32 and 34 mounted within or near the tube 12 for deflecting the optical image along the x axis. In order to provide a streak generator means or circuit which provides a stable operating point for the streak generator with reduced fluctuations and large time dependent deflections of the electron beam, a secondary voltage generator means is provided in addition to a primary pulsed voltage generator means used to generate a ramp signal applied to one or both of the deflection plates 32 and 34. The secondary voltage generator means are connected to the deflection plates in proper fashion to produce a deflection of the electron beam in the opposite direction to that produced by the primary voltage generator means.

In general, it is desirable that any change in the primary pulsed voltage caused by fluctuations in the incident light intensity be substantially equal to any change in the secondary voltage caused by the same changes in the incident light intensity. In this manner, any changes in the primary pulsed voltage are cancelled out by the substantially same magnitude of change in the secondary voltage. The primary pulsed voltage and the secondary voltage are both preferably voltages of identical or proportional magnitudes. In this manner, variations due to light pulse fluctuations of the primary pulsed voltage at a given time instant will be identical to corresponding variations of the secondary voltage at the same time instant. Further, the circuit examples described hereafter provide a stable operating point for the streak camera and, further, offset or delay the secondary compensating pulse voltage from the primary pulsed voltage with respect to time such that the derivative of the secondary voltage is zero or neglibly small at a time where the derivative of the primary pulsed voltage exhibits large fluctuations.

Ideally, the following embodiments provide the following function:

$$dD_{pri}/dI_L+dD_{sec}/dI_L=O$$

Where $D_{pri}$ is the deflection produced by the primary pulsed voltage, $I_L$ is the light intensity, and $D_{sec}$ is the deflection produced by the secondary voltage. This function can be achieved by many different circuits, examples of a few of which are presented herein.

Figure 2:
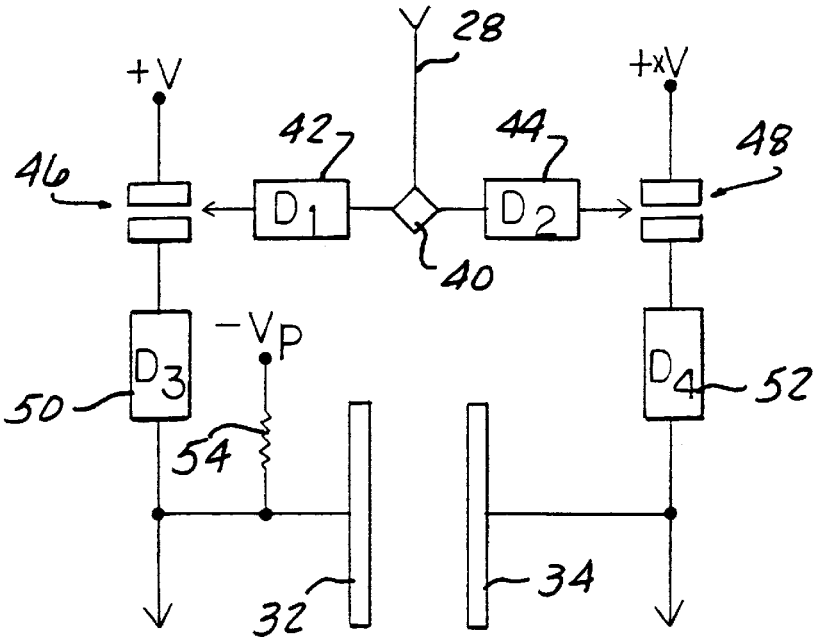
FIG. 2 is a schematic diagram of one embodiment of a sweep generator circuit according to the present invention.

One embodiment of the streak generator circuit is shown in FIG. 2. In this embodiment, the primary voltage generator means includes a first light operated switch 46. A positive voltage is applied to the switch 46 as described hereafter. In this embodiment, the reflected pulse 28 strikes a second beam splitter 40 wherein it is split into two light signals which respectively pass through first and second optical delay means labeled 42 and 44 which produce time delays, respectively, in the first and second signals from the beam splitter 40. The optical delay means 42 and 44 may comprise fiber optic cables or simple air spacings or gaps. The cables or gaps may have equal or unequal lengths. The time delay $t_1'$ may be equal to, greater than, or less than $t_2'$.

First and second solid state switches, such as photoconductors 42 and 44, are connected to each optical delay means 46 and 48, respectively, by placing the end of a bundle of optical fibers in front of the switch 42 or 44 which formed a body of semi-insulating, semiconductor material of high resistance in the absence of activating radiation or light. In a preferred form, the semi-insulating semiconductor material is gallium arsenide (GaAs). Other semiconductor, semi-insulating materials may also be used. The photoconductors 46 and 48 become photoconductive when activated by radiation or light and have a relatively short recombination time.

Thus, the split light pulses from the beam splitter 40, after passing through the optical delay means 42 and 44, activate the solid state switches or photoconductors 46 and 48 making each of the photoconductors 46 and 48 conductive. When the first photoconductor 46 is rendered conductive, the positive voltage (+V) is applied through the photoconductor 46 to a third delay means 50 having a third delay period $t_1$. The third delay means 50 may be in the form of an electrical cable of a selected length. When the second photoconductor 48 is made conductive, a positive voltage (+xV) is applied to a fourth optical delay means 52 having a delay period $t_2$. The constant "x" is less that "1" and represents a voltage less than +V.

The electrical signal transmitted to the third optical delay means 50 is applied to the first deflection plate 32. A suitable d.c. polarization voltage −Vp is also connected to the first deflection plate 32 through a resistor 54.

For proper operation, the time period $t_1$ is made equal to, less than, or greater than $t_2$ and $t_1'$ is also equal to, less than, or greater than $t_2'$. Further, the total time difference is determined by:

$$\Delta t=(t_1+t_1')-(t_2+t_2')$$

Δt must be smaller than the recombination time of the photoconductors 46 and 48 which is generally in the three nanosecond range for GaAs photoconductors. At must also be much greater than the charging time on the deflection plates 32 and 34. Typically, the charging time is approximately 0.5 nanoseconds.

Figure 3A:
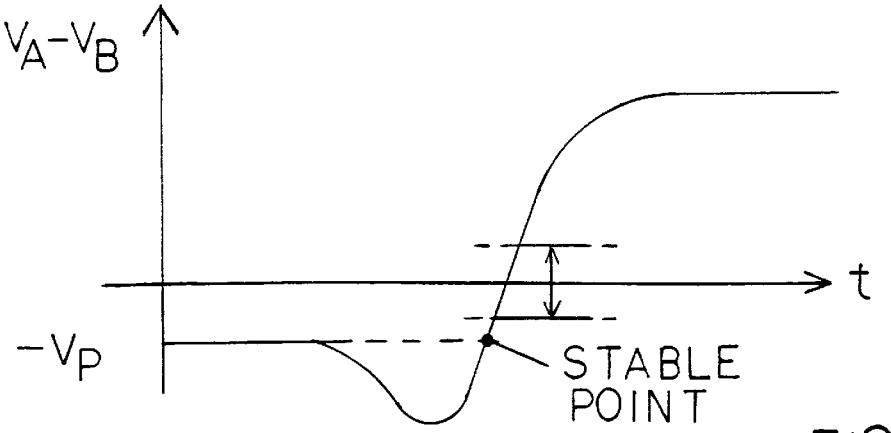
FIGS. 3A and 3B are graphs depicting the operation of the sweep generator circuit shown in FIG. 2.

Under these conditions, as shown in FIG. 3A, the measuring range provided by the voltage across the deflection plates 32 and 34 as determined by the difference $(V_A-V_B)$ will exhibit small fluctuations under any fluctuations in the incident light intensity. As shown in FIG. 3A, the embodiment described above and shown in FIG. 2 provides a stable operating point substantially equal to $V_P$ while at the same time, provides large voltage variations as a function of time within the measuring range, as denoted by the arrow in FIG. 3A.

Figure 3B:
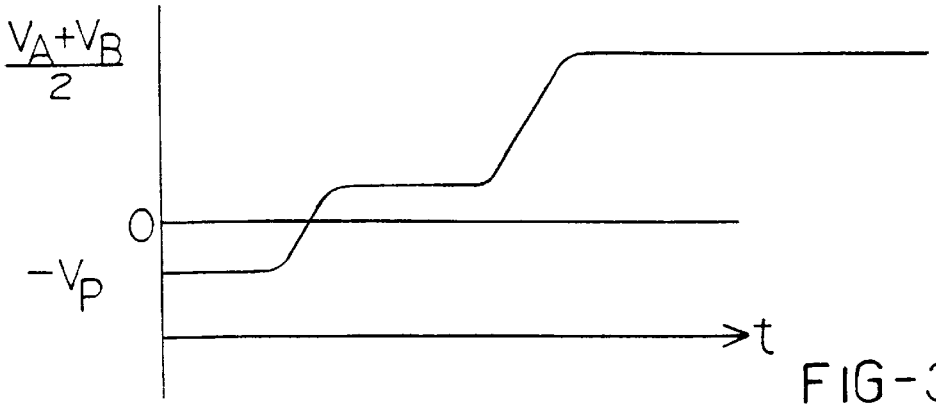

However, some streak camera systems require that average of $V_A$ and $V_B$ equal zero. As shown in FIG. 3B, the average of $V_A$ and $V_B$ in this embodiment of the sweep generator circuit does not always equal zero.

Figure 4:
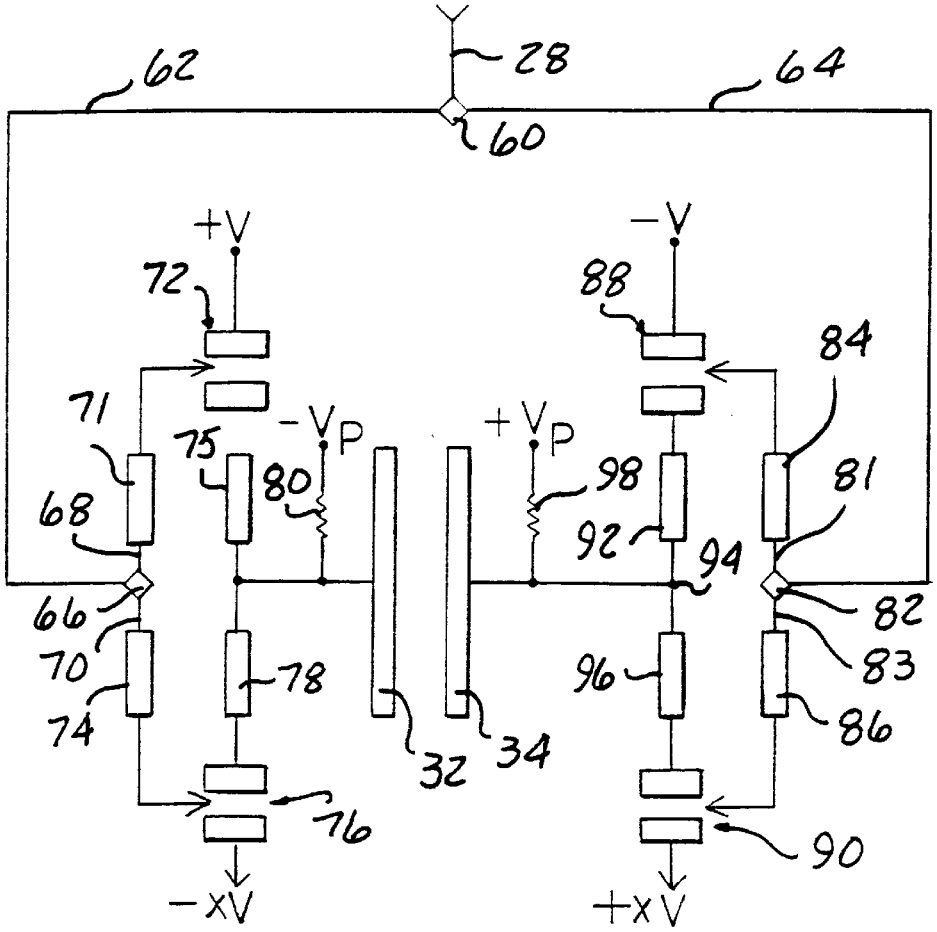
FIG. 4 is a schematic diagram of another embodiment of a sweep generator circuit according to the present invention.

FIG. 4 depicts a second embodiment of a sweep generator circuit in which the average of $V_A$ and $V_B$ always equals zero. The circuit shown in FIG. 4 is similar to that of FIG. 2 in that the reflected light pulse 28 is split by a beam splitter 60 into two separate light pulses including a first light pulse 62 and a second light pulse 64. The primary pulsed voltage generator, in this embodiment, is formed of two light operated switches, each connected to opposed polarity voltage sources and to one deflection plate 32 or 34. The secondary voltage generator means is also formed of two light operated switches, each connected to a −xV and a +xV voltage source, respectively, and to the deflection plates 32 and 34.

In this embodiment, the first light pulse 62 is further split by a beam splitter 66 into third and fourth light pulses 68 and 70, respectively. The third light pulse 68 is transmitted through a first optical delay 71, such as a preset length fiber optic tube or air spacing, having a delay period $t_3'$ to a first solid state switch or photoconductor 72. The fourth light pulse 70 transmitted through a second optical delay means 74 having a delay period of $t_4'$ to activate a second solid state switch or photoconductor 76. The output of the first photoconductor 72, when conductive, connects a positive +V through a third delay means 75 having a delay of $t_3$ to a junction with a −xV voltage transmitted from the second photoconductor 76 through a fourth delay means 78 with a delay period $t_4$. The combined signal from the two optical delays 75 and 78 is superimposed on the first deflection plate 32 with a d.c. polarization voltage $(-V_p)$ applied through resistor 80.

The second light pulse 64 is further split by a beam splitter 82 into two separate light pulses 81 and 83 that are transmitted through fifth and sixth optical delays 84 and 86, respectively, each with delay periods of $t_1'$ and $t_2'$, respectively. The outputs of the optical delays 84 and 86 are respectively applied to third and fourth solid state switches or photoconductors 88 and 90. When conducting, photoconductor 88 connects a (−V) voltage through an electrical delay 92 to a junction 94. When conducting, the fourth photoconductor 90 connects a (+kV) voltage through a separate electrical delay 96 to the junction 94. The junction 94 is electrically connected to the second deflection plate 34 along with a $(+V_p)$ d.c. polarization voltage through resistor 98.

Figure 5:
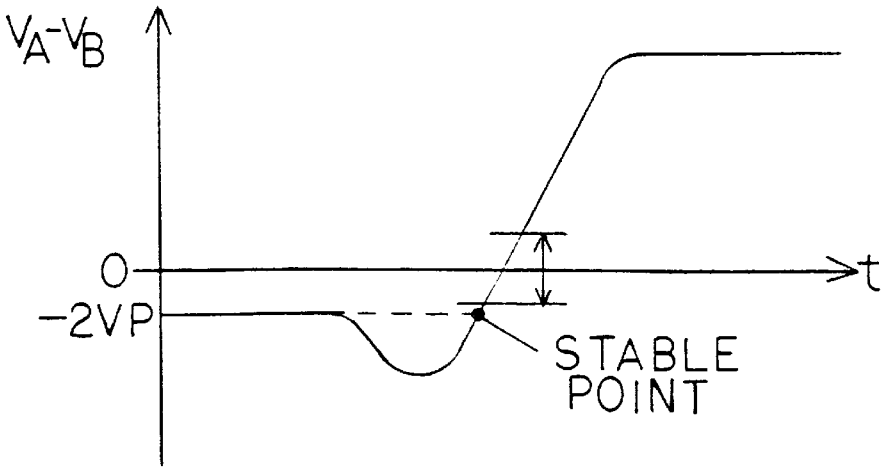
FIG. 5 is a graph depicting the operation of the sweep generator circuit shown in FIG. 4.

As shown in FIG. 5, the circuit depicted in FIG. 4 operates to provide a stable operating point while the average of $V_A$ and $V_B$ is substantially zero at all times.

Figure 6:
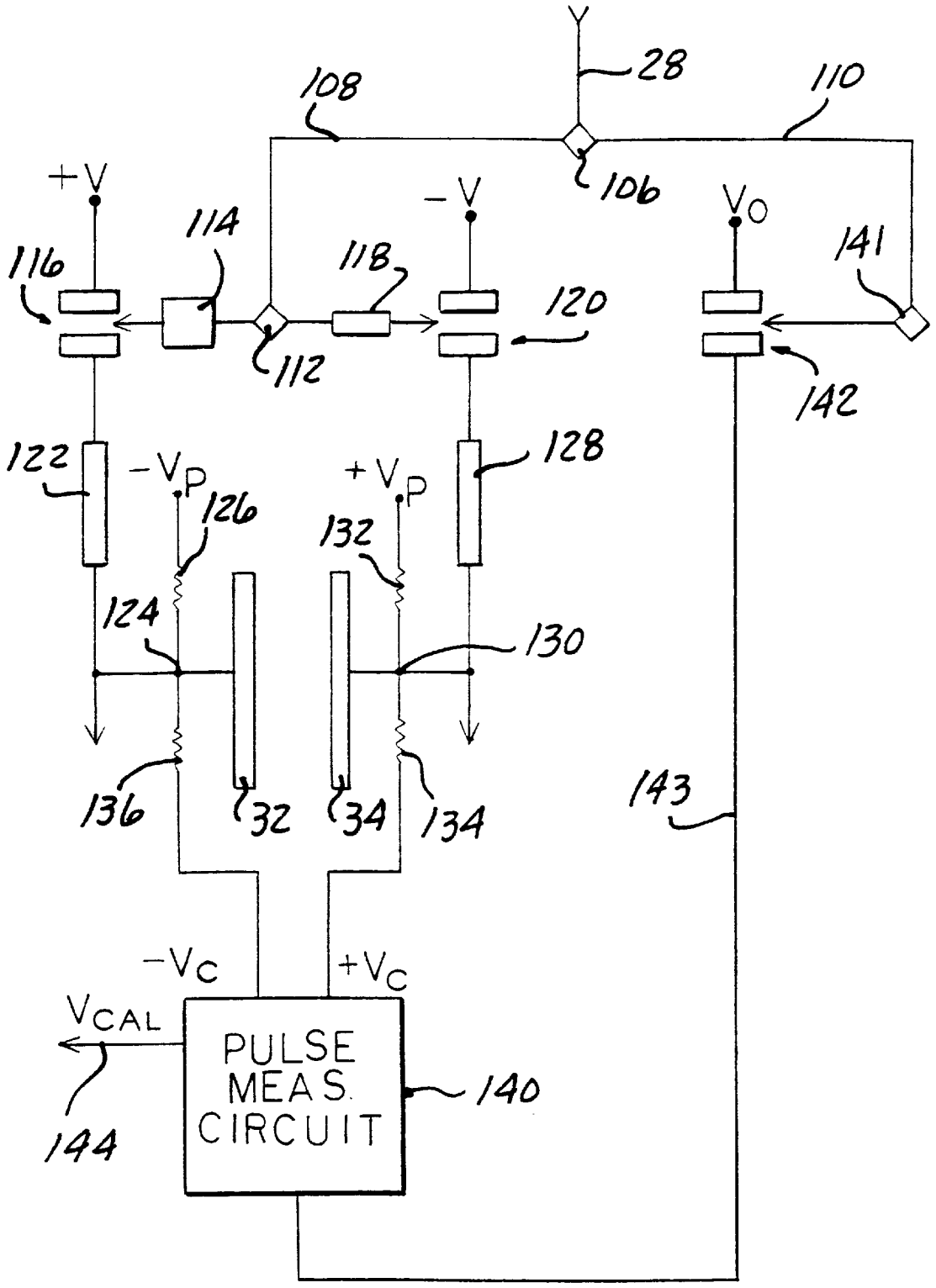
FIG. 6 is a schematic diagram of yet another embodiment of a sweep generator circuit according to the present invention.
Figure 7:
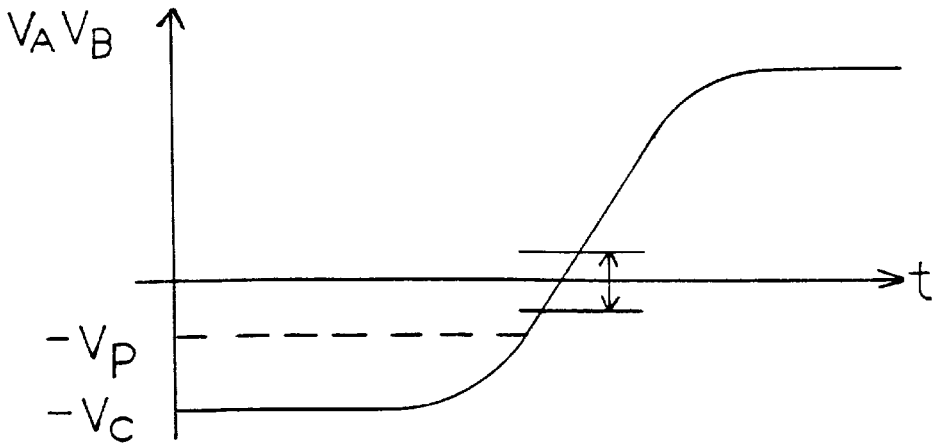
FIG. 7 is a graph depicting the operation of the sweep generator circuit shown in FIG. 6.
Figure 8:
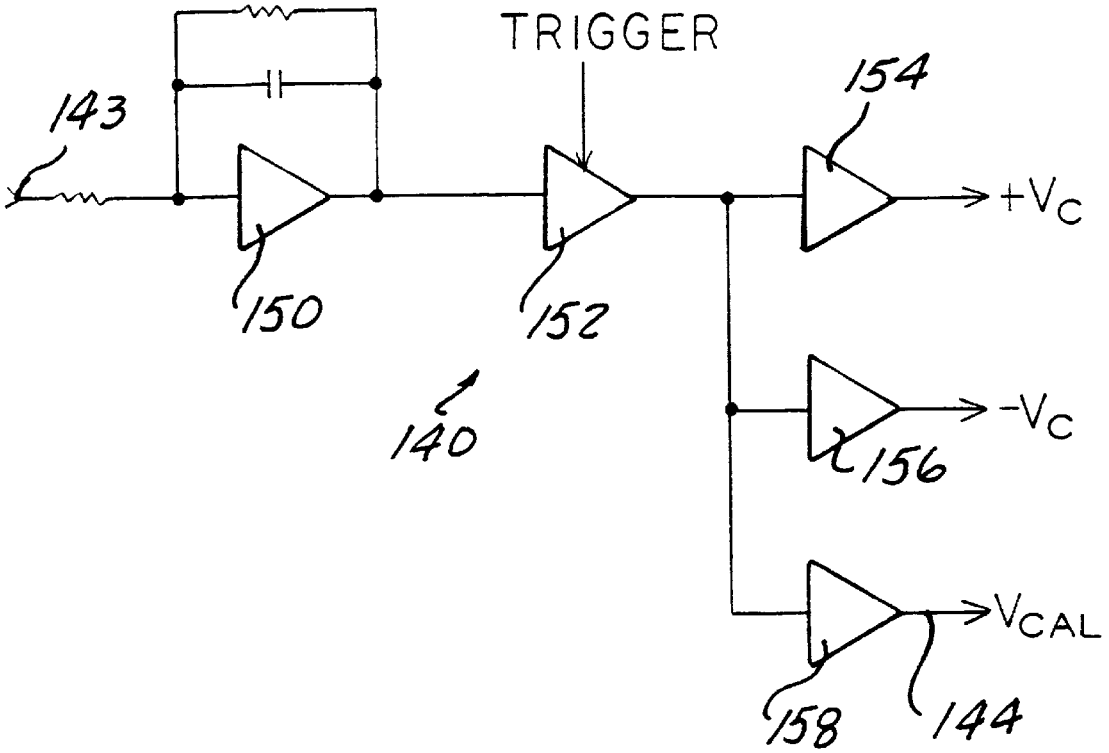
FIG. 8 is a schematic diagram of a pulse measuring circuit usable in the sweep generator circuit shown in FIG. 6.

Turning now to FIGS. 6 and 7, there is depicted yet another embodiment of a sweep generator circuit that may be employed in the streak camera 10. In this embodiment, the primary pulsed voltage generator includes switches 116 and 120.

The reference light pulse 28 is split by a beam splitter 106 into first and second light pulses 108 and 110, respectively. The first light pulse 108 is further split by a beam splitter 112 into two separate light pulses, each of which passes through first and second optical delay means 114 and 118. Each of the delay means 114 and 118 has a respective delay period of $t_1'$ and $t_2'$, which are equal to each other. The outputs of the first and second delay means 114 and 116 are connected to and activate first and second photoconductors 116 and 120, respectively. The first photoconductor 116 is connected to a +V voltage source; while the second photoconductor 120 is connected to a −V voltage source.

The output of the first photoconductor 116 is connected through a third electrical delay means 122 having a delay period of $t_1'$ to a junction 124. A $(-V_P)$ voltage is connected through resistor 126 to the junction 124 and to the first deflection plate 32.

Similarly, the output of the second photoconductor 120 and the output of the fourth electrical delay means 128 is connected to a junction 130 along with a $+V_B$ voltage through resister 132, which is applied to the second deflection plate 34.

In this embodiment, the secondary voltage generator means includes a pulse measuring circuit 140 which acts as a d.c. voltage generator providing a d.c. voltage to the deflection plates 32 and 34 to define the stable operating point of the streak generator. The pulse measuring circuit 140 provides $+V_c$ and $-V_c$ signals through resistors 134 and 136, respectively, to the junctions 130 and 124. The $+V_c$ and $-V_c$ signals are derived from a voltage calibration signal and depend on the intensity of the incident light. A third photoconductor 142 receives the second reflected signal 110 from the beam splitter 106. The output of the third photoconductor 142 is applied to an input of the pulse measuring circuit 140 as shown in FIGS. 6 and 7. The output 143 from the third photoconductor 142 is applied to an input of an integrating amplifier 150 connected provided with appropriate feedback. The output of the amplifier 150 is connected to an input of a sample and hold amplifier 152 supplied with an appropriate trigger input. The output of the sample and hold amplifier 152 is connected to the inputs of three output drivers or amplifiers 154, 156, and 158. Amplifier 154 provides a $+V_c$ high voltage positive output. Amplifier 156 provides a $-V_c$ low voltage negative output. Amplifier 158 provides a low voltage calibration outputting labeled $V_{Cal}$. The $V_{Cal}$ signal provides a sweep rate correction to each output image.

As shown in FIG. 7, the long term stable point of the sweep generator circuit shown in FIG. 6 remains within a relatively small measuring range and eliminates the negative going portion of the difference between the $V_A$ and $V_B$ shown in FIGS. 3A and 5 depicting the operation of the first two embodiments of the sweep generator circuit.

The sweep generator circuit shown in FIG. 6 works ideally with slow fluctuations in light intensity amplitude; but does not correct for pulse to pulse fluctuations. With slow fluctuations in the incident light amplitude, the sweep generator circuit shown in FIG. 6 uses the compensating voltage to create a stable point near the measuring range as shown in FIG. 7.

What is claimed is:

1. A sweep generator for a streak camera having first and second deflection plates for deflecting an electron beam resulting from an incident light beam, the sweep generator comprising:

a reference light pulse split from an incident light beam;

primary pulsed voltage generator means, connected to the first and second deflection plates and including at least one switch operated by the reference light pulse, for producing a primary pulsed voltage to deflect the electron beam in one direction;

a secondary voltage generator means connected to the first and second deflection plates, for producing a secondary voltage to deflect the electron beam in a direction opposite to the first direction;

the primary pulsed voltage generator means and the secondary voltage generator means arranged such that fluctuations in the primary pulsed voltage due to fluctuations in the reference light beam are substantially equal to fluctuations in the secondary voltage due to the fluctuations in the reference light beam; and variations in deflection of the electron beam with respect to time by the secondary voltage are small in comparison to variations in deflection caused by the primary pulsed voltage.

2. The sweep generator of claim 1 wherein:

the primary pulsed voltage and the secondary voltage are shifted in time with respect to each other.

3. The sweep generator of claim 1 further comprising:

substantially identical switches in the primary pulsed voltage generator means and the secondary voltage generator means and substantially identical exciting light conditions from the reference light pulse on each of the switches.

4. The sweep generator of claim 1 wherein:

the primary pulsed generator means and the secondary voltage generator means apply a primary pulsed voltage to the first deflection plate and a secondary voltage to the second deflection plate of identical voltage polarity.

5. The sweep generator of claim 4 wherein:

the secondary voltage is proportional to the primary pulsed voltage.

6. The sweep generator of claim 1 wherein:

the primary pulsed voltage generator means provides a primary pulsed voltage to each of the first and second deflection plates of opposing polarity; and the secondary voltage generator means provides a secondary voltage to each of the first and second deflection plates of opposing polarity.

7. The sweep generator of claim 6 wherein:

the primary pulsed voltage generator means includes at least first and second switches; and the secondary voltage generator means includes at least first and second switches.

8. The sweep generator of claim 1 wherein:

the secondary voltage is a d.c. voltage generator providing a d.c. voltage signal.

9. The sweep generator of claim 8 wherein the d.c. generator means comprises:

a switch identical to the at least one switch in the primary pulsed voltage generator means and responsive to substantially identical exciting light conditions the d.c. generator means providing the d.c. voltage after a predetermined number of reference light pulses.

10. The sweep generator of claim 1 further comprising:

a polarizing voltage applied to at least one of the first and second deflection plates to position a stable point of the electron beam with respect to an image screen.

11. The sweep generator of claim 1 further comprising:

means for splitting the reference light pulse into first and second light pulses;

means for delaying the first and second light pulses;

the secondary voltage generator means including a second switch means;

second means for delaying an output signal from each of the first and second switch means before applying the output signal to the first and second deflection plates, respectively.

12. The sweep generator of claim 11 wherein the first delaying means comprises optical delay means.

13. The sweep generator of claim 11 wherein the second delaying means comprises electrical means.

14. The sweep generator of claim 11 wherein the first and second switch means comprise photoconductors.

* * * * *